United States Patent [19]

Matthews

[11] Patent Number: 4,666,178

[45] Date of Patent: May 19, 1987

[54] SKI CLIMBER

[76] Inventor: Donald R. Matthews, 2224 Temple View Dr., Provo, Utah 84604

[21] Appl. No.: 739,896

[22] Filed: May 31, 1985

[51] Int. Cl.[4] ..... A63C 5/00

[52] U.S. Cl. ..... 280/604

[58] Field of Search ..... 280/601, 604, 608, 609, 280/610, 809

[56] References Cited

FOREIGN PATENT DOCUMENTS

| | | | |
|---|---|---|---|
| 736902 | 12/1932 | France | 280/604 |
| 810162 | 3/1937 | France | 280/604 |
| 50972 | 2/1910 | Switzerland | 280/604 |
| 62154 | 7/1913 | Switzerland | 280/604 |
| 84074 | 4/1919 | Switzerland | 280/604 |

OTHER PUBLICATIONS

Climbing Skins; p. 11; Alpine Research, Int. Boulder Colorado.

Product Instructions Montana Sport 6052 Hergiswil GmbH Switzerland.

Temporary Product Information Page Scotchmate Mushroom and Loop Fastening System.

Product Information Scotchmate Hook and Loop Fastening Systems.

*Primary Examiner*—John J. Love

*Assistant Examiner*—Richard Camby

*Attorney, Agent, or Firm*—K. S. Cornaby

[57] ABSTRACT

The invention discloses an improved ski climber system that overcomes a number of long-standing climber problems by (1) eliminating the tendency of climbers to slide out from under the ski on turns and traverses through the use of plastic stiffeners, (2) providing a more positive and faster means of climber attachment and removal from skis by the use of mushroom and loop fasteners, (3) strap protection from ski edges, rocks, and ice and strap replacement through the use of plastic panels and strap slots in the climber, (4) climber removal without the necessity of ski removal through an improved tail section design, (5) ultrasonic sealing of nylon or polypropylene climber fabrics to prevent fraying, (6) the accommodation of very narrow widths of climber fabric for touring and racing, (7) longitudinal climber adjusting and tensioning, and (8) one climber length that fits most skis.

16 Claims, 8 Drawing Figures

SKI CLIMBER

DISCLOSURE STATEMENT

Pursuant to paragraphs 1.56 and 1.97, Title 37, CFR, a patent search was conducted with staff assistance at the University of Utah Patent Depository Library (DPL) using (1) Index to the U.S. Patent Classification, (2) Manual of Classification, and (3) The Classification and Search Support Information System (CASSIS) data base.

Many classes and sub-classes were reviewed, the most relevant of which is Class 280 (Land Vehicles), sub-class 601 (SKIS), 604 (. . . Climbing on braking means), and 809 (Ski or skate appliance or attachment). None of these references, in my opinion, provide material information regarding issued patents relevant to this application.

However, the following information does assist in providing prior art references for this application along with my discussion in the section entitled Description of Prior Art:

a. Page 11 from the 1985 Alpine Research, Inc. (Boulder, Colorado) catalog which lists ski climbers and accessory products along with a discussion of climber fabrics and their qualities.
b. Instructions for use of adhesive-applied ski climbers made by Montana Sport, Hergiswil, Switzerland.
c. Literature available from 3M® Corporation regarding the use of their Fibertran® as a ski climber that is inletted into the ski.

DESCRIPTION OF PRIOR ART

Ski climbers, climbing skins, or "skins" as they are variously known, have been in use for centuries, and their method of construction and use has been well known for many years. The belly portions of hides from sea animals such as seals were commonly used because during the brief periods of time in which these animals traveled on ice, snow, or land, they slithered on their bellies causing the hair to grow flat in one direction. This unidirectional fur was cut in strips the width of a ski with the fur lying to the rear, and the pieces were sewn end to end and fastened to the under side of skis. This enabled the skier to move forward but not backward thus enabling him to climb very steep slopes without having to herringbone or side step while still enabling him to glide forward down hill or on level terrain.

During World War II thousands of mountain combat troops from Norway, Finland, Italy, and the United States' 10th Mountain Division were known to have used ski climbers extensively. The construction of the climbers used by U.S. forces was known to have been mohair slant pile woven into a fabric backing which in most cases was treated with a latex or plastic solution. The climber was then strapped to the ski. Variations of this approach are still in use by the Army today.

During the past decade, climbers are known to have been produced by companies such as Montana Sport in Switzerland with flexible rubber or plastic backing ranging in thickness from a film 2–5 mils thick up to ¼ inch thick backing in an attempt to add rigidity to the climber so that it would not slide out from under the ski. This approach was essentially unsatisfactory because it did not provide sufficient rigidity, and an oppressive amount of weight was added in the thicker designs.

More recent innovations are known to include the use of Montana Sport, Alpine Research, Inc., and Colltex® adhesives in an attempt to attach climbers to skis so that they will not slide out from under the ski. This objective is obtained to some extend if the ski bottoms are perfectly clean and free of snow, moisture, and contamination and if the climbers are not torn loose by ice or debris during turns and traverses. In addition to the fragile nature of the product and its tendency to detach from the ski especially at the tail section, the adhesive method of attachment is tedious and relatively slow because a set of climbers has to be rolled up in a piece of plastic the length of the climber to protect it from contamination, and debris, and to keep it from attaching itself to other objects and materials. After the climbers are attached to the ski, one must carry the two plastic strips in a roll until they are again used to store the climbers. The layer of adhesive must be renewed from time to time, and some skiers find it necessary in case of an energency to carry a can of adhesive with them while skiing.

The 3M® Corporation is known to have manufactured and to have unsuccessfully marketed a climber made from their synthetic slant pile fabric called Fibertran®. A very narrow strip of Fibertran® in kit form was permanently inletted into the ski bottom by the skier or a ski shop for racing and touring applications. These climbers could not be removed and the ski had a permanent longitudinal groove inletted into it.

More recently a climber has been produced by a Utah mountain club that is made entirely from a single piece of plastic without slant pile fabric that stretches longitudinally to fit different sizes of skis and depends on convolutions or raised patterns in the plastic and characteristics of the plastic itself to obtain its climbing qualities. While it has good climbing qualities, some object to its excessive weight, but more particularly to its poor forward glide qualities, especially in the downhill mode.

The climber problems that have remained unsolved until this invention have centered primarily on (1) positive methods of attachment, (2) stiffening methods and materials that prevent lateral climber movement in turns and traverses consistent with retention of a (3) light weight product that is (4) quick and easy to use and transport while achieving good climbing, gliding, and downhill characteristics, especially in turns.

DETAILED DESCRIPTION

Figure 1:
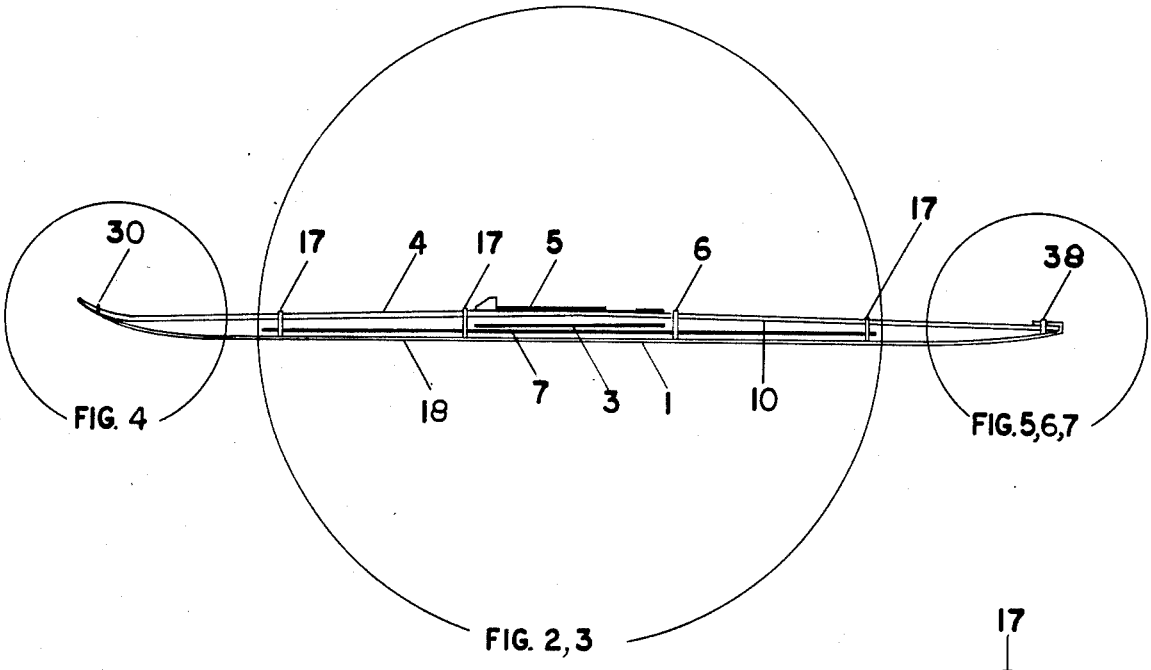
FIG. 1 is a left side view of the ski and climber with major parts separated for clarity and a key for locating the other figures.
Figure 2:
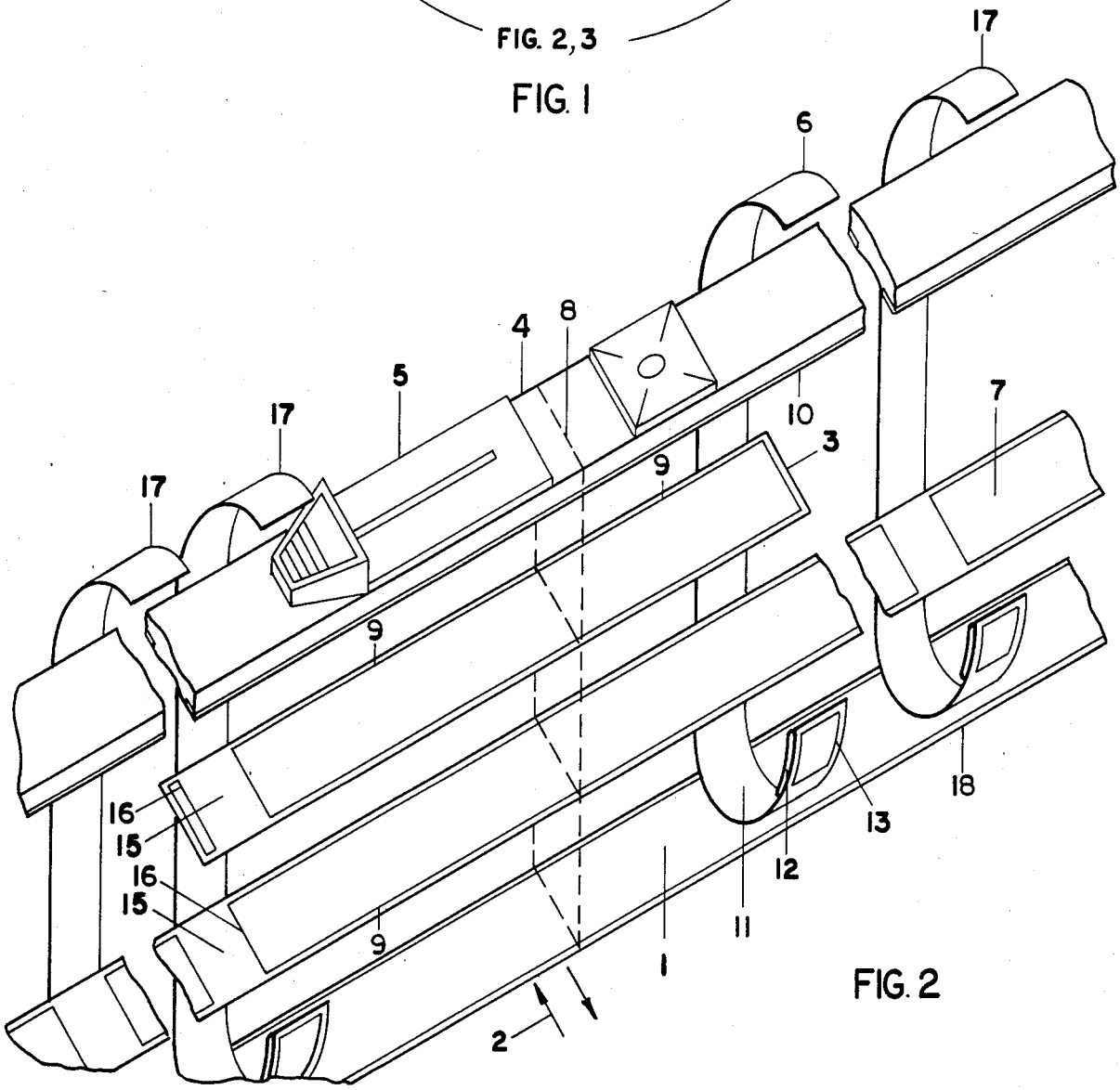
FIG. 2 is an exploded perspective view of the first embodiment of the invention looking down on the top left side.

This invention is an improvement over known art. In the initial embodiment of this invention as seen in FIGS. 1 and 2 the primary objective is to overcome the effects of climber 1 lateral or side loading 2 during skiing turns and traverses wherein a sandwich is constructed, the top layer of which is composed of a panel of high density polyethylene or G-10 plastic 3 approximately 15 to 40 mils thick that is the width of the ski 4 and the length of the binding 5. This panel is located under the binding 5 and provides lateral resistance 2 to climber 1 movement in the binding area 5 where side loads 2 are the greatest. Climber 1 attachment is very difficult at the center of the ski where it is most needed because the boot binding 5 blocks the use of body straps 6, 17 or other attachments. The first layer of the sandwich serves as a bridge over the boot binding 5 eliminating the need for climber 1 attachment in this area.

A second layer is made from another piece of high density polyethylene or G-10 plastic 7 of similar width and thickness and approximately four feet long, depending on ski 4 size, that is centered under the first sandwich layer 3. This layer 7 doubles the strength of the first layer 3 under the boot binding 5 where side loads 2 on the climber 1 are the greatest. This layer 7 also provides resistance to lateral climber 2 movement over a larger portion of the climber, approximately 50 to 60 percent. Because lateral loads 2 in most of this area are of much lesser magnitude, a single thickness of plastic is adequate.

To reduce climber weight, no plastic is used over the remainder of the climber where side loading 2 is either insignificant or non existent. Dashed visual orientation lines 8 have been added to assist in demonstrating the sandwich construction.

The third layer 1 is made from a climber 1 that is composed of animal hide with fur attached, mohair, solid plastic, 100 percent nylon fabric, 100 percent polypropylene fabric, or a combination thereof.

All layers of the sandwich are stitched 9 together in one operation with thread such as nylon or polyester, but not limited to these compositions, ranging in size up to V125 depending on ski dimensions. As alternatives, any of a variety of urethane adhesives are applied over all sandwich surfaces or ultrasonic welding is used in the same area where stitching 9 is applied.

The climber 1 is rolled longitudinally on a short radius for storage and transport, or the plastic may be scored laterally and the climber is folded on the scores.

The advantages are: (1) the climber 1 is kept flat and resists rolling under the ski 4; (2) the climber 1 is retained within the edges 10 of the ski, instead of sliding out from under it; (3) the selective placement of short and medium length plastic panels 3 and 7 at strategic locations on the climber 1 eliminates the need to single or double reinforce the entire length of the climber 1 as is necessitated by known art in which continuous extruded climber yardage is manufactured with attached backing of constant thickness over the entire length of the climber even where no backing is needed. The resulting weight reduction in this invention is a significant advantage; and (4) the area of the boot binding 5 is effectively bridged eliminating the need for climber 1 attachment at this location.

The climber 1 is attached to the ski 4 with fixed 6 or removable 17 body straps. The fixed body straps 6 are made from 3M ® Corporation Mushroom and Loop System material that are sewn 9 in place. The body 11 of each fixed body strap is made from loop material and the tab 12 is made from mushroom material that is sewn to the body 11 of the strap around the edges of the tab 13.

The advantages over known art are: (1) the mushroom and loop material provides much greater shear strength at the strap closure than typical Velcro ® or 3M ® hook and loop-type fasteners by a factor of about 10— see 3M ® Corporation comparison specifications. Hook and loop fasteners do not have enough shear strength to be used in this invention, so not only is the mushroom and loop fastener an improvement, but it makes this invention possible; (2) quick climber 1 attachment to and removal from the ski 4; (3) additional weight reduction because no metal or plastic buckles or snaps are used; and (4) the high density polyethylene plastic panels 3 and 7 shield the body straps 6, 17 from being cut by the sharp metal ski edges 10, a common fault of known art.

An alternative method of attachment is to provide lateral slots 15 in the body of the climber that are sewn 16, urethane glued or ultrasonically welded 16 through which removable body straps 17 are passed.

Additional advantages over known art are: (1) the removable body straps 17 can be easily replaced when worn; and (2) when somewhat narrower climbers are used, they are free to float to the uphill or inside edge of ski 4 (either edge depending on whether one is turning right or left), but not beyond the ski edge 10, thus keeping the climber 1 in constant contact with the snow and continuously working for the skier instead of being idled during turns and traverses.

The edges 18, FIGS. 1 and 2, of 100 percent nylon or 100 percent polypropylene climber fabric are ultrasonically sealed.

The advantages over known art are: (1) fraying of the fabric edges 18 is prevented more effectively than by using natural or synthetic sealers as in known art which tend to break down and are less durable; (2) ultrasonic welding is faster; and (3) less expensive.

Figure 3:
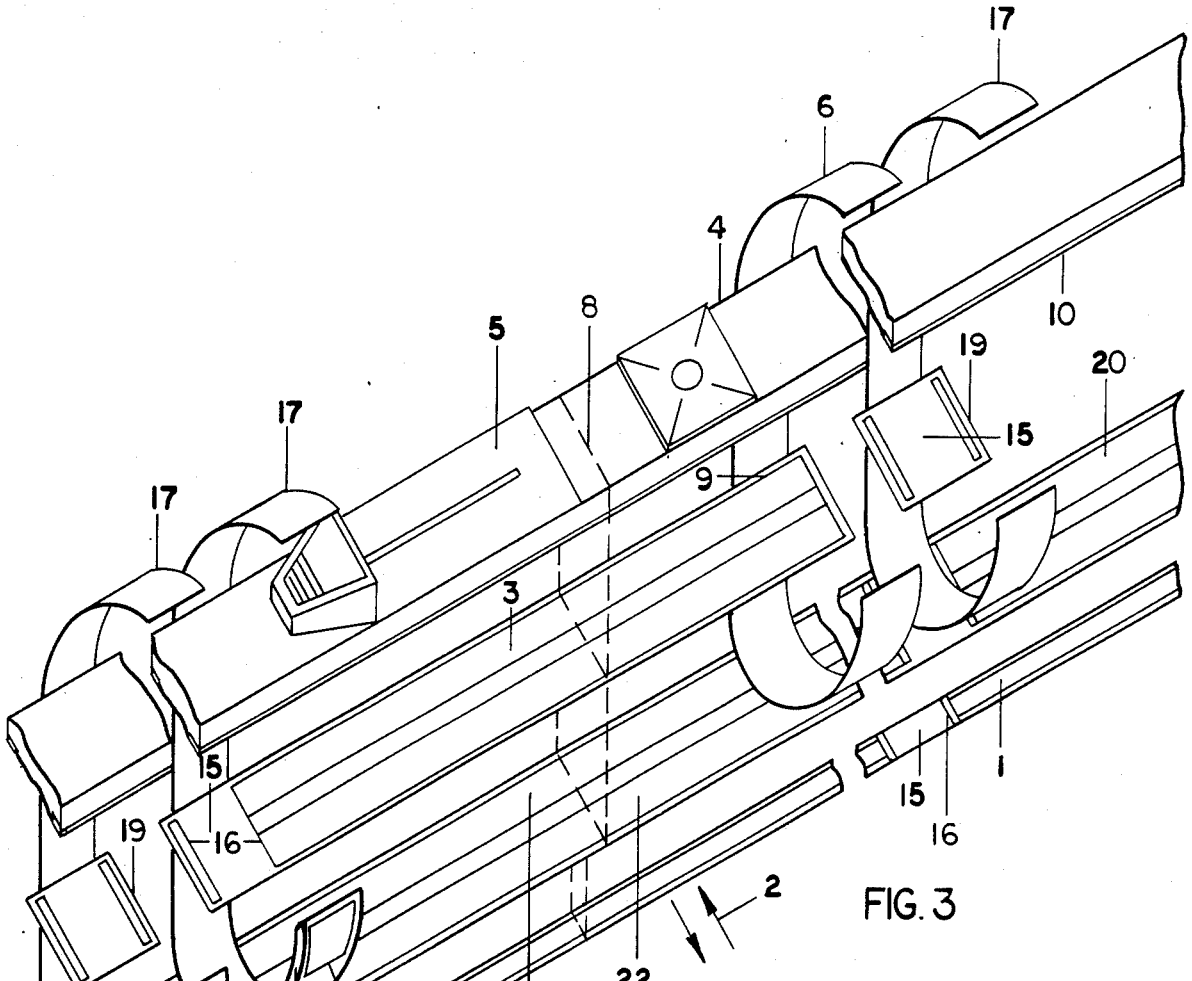
FIG. 3 is an exploded perspective view of the second embodiment of the invention.

A second embodiment of the invention as seen in FIG. 3 provides for the use of extremely narrow racing and touring widths of climbers as well as standard widths. This invention will accommodate climber 1 widths as narrow as ⅜ inch. A sandwich is constructed the first layer of which is composed of a thin panel of high density polyethylene or G-10 plastic 3 approximately 15 to 40 mils thick that is the width of the ski 4 and the length of the binding 5. This panel is located under the binding 5 and provides lateral resistance 2 to climber 1 movement in the binding area 5 where side loads are the greatest. The first layer also contains very short high density polyethylene or G-10 plastic panels 19 that provide lateral resistance 2 and strap 6, 17 protection from ski edges 10. These are placed over a second layer composed of fixed body straps 6 or removable body straps 17 for climber attachment to the ski 4. Fixed body straps 6 are stitched 9 as part of the sandwich stitching, secured with urethane adhesives, or ultrasonically welded 9. Removable body straps 17 slide in lateral climber body slots 15 that are stitched 16 or ultrasonically welded 16. The third layer is made from another piece of plastic 20 approximately four feet long depending on ski size, that provides: (1) additional lateral resistance 2 to climber 1 movement over the length of the plastic panel 20 and which doubles the strength of the short plastic panel 3 under the boot binding 5; (2) a surface for the attachment of the fourth sandwich layer that is made of very narrow widths of climber 1 at the center of the sandwich; (3) strap 6, 17 protection from exterior objects; and (4) a waxable skiing surface 22 (underside) that is free from strap 6, 17 drag against the snow. All parts of the sandwich are sewn 9 or 16, ultrasonically welded 9 or 16, or adhered together with urethane adhesives in one operation. The forward part of the plastic panel 23 is tapered over a distance of a few inches longitudinally from the width of the forward portion of the climber 24 to the width of the ski 25 to provide minimum resistance to forward motion against the snow.

To reduce climber weight, no plastic is used over the remainder of the climber where side loading 2 is either insignificant or non existent. Dashed visual orientation lines 8 have been added to assist in demonstrating the sandwich construction.

The completed climber is rolled longitudinally on a short radius for storage and transport or the plastic is scored and the climber folded flat.

The advantages over known art are: (1) the portion of the climber that is under the ski binding 5 and between the straps that are immediately forward and to the rear of the binding 5 has been effectively bridged or stiffened to prevent climber 1 lateral movement 2 outside the ski edges 10. No known art has accomplished this except through climbers attached with adhesives because the boot binding 5 blocks any means of attaching the climber 1 to the ski 4 in this area. The use of adhesive incurs so many problems as set forth in advantage number (11) below as to render climber attachment by this method an unlikely choice when compared to this invention; (2) the last piece of plastic 20 covers the straps 6, 17 and completely eliminates any drag that is otherwise created under the ski 4 between the straps 6, 17 and the snow; (3) extremely narrow widths of climber 1 can be used without inletting the fabric permanently and irreversibly into a groove that is cut in the ski 4. This inletting method introduced by 3M® Corporation is the only known art that will enable the use of very narrow widths of climber. It is no longer marketed. Climber fabric is too fragile in extremely narrow widths to be attached to the ski with straps unless it is plastic-backed as in this invention. The climber fabric surface is too small in extremely narrow widths to afford proper adhesion to the ski when commonly used Coll-tex® type adhesives are used—; (4) even when wider widths of climber fabric are adhered to the ski with Coll-tex® type adhesives, the annoyance of working with tacky adhesives is totally eliminated in this invention as well as the necessity for meticulously storing the climber in bulky plastic rolls; (5) straps 6, 17 are protected from ski edges 10 by the first pieces of plastic 3, 19 and from exterior objects such as rocks and ice by the last piece of plastic 20; (6) the last plastic panel 20 provides a surface 22 (underside) to both sides of the climber 1 that is of the same basic composition as most ski running surfaces made today—polyethylene. This provides a durable low friction skiing surface essentially equivalent to the ski itself; (7) these polyethylene skiing surfaces can also be waxed with a wide variety of waxes to compliment climbing, touring, and racing applications, while the running surface of the ski itself can be waxed ahead of time for the downhill run once the climbers have been removed providing a significant time saving and convenience. Waxing in this manner is not possible with most adhesive-adhered climbers because the adhesives will adhere to few if any waxes; (8) the polyethylene panels 3, 19, 20 are extremely durable and abrasion resistant, adding significant strength to otherwise fragile climber fabric regardless of the fabric's design to make; (9) the polyethylene 3, 19, 20 is very flexible in the thin configurations set forth herein (15–40 mils) so that climbers can be stored or transported in short radius rolls or the plastic can be laterally scored and the climbers folded flat on the scores for transport in skier "fanny packs;" (10) the mushroom and loop tab closures 12 on the body straps 6, 17 are extremely fast to use compared to attachment methods of known art such as adhesives or buckles through which conventional straps must be threaded; and (11) when compared to climbers of known art wherein extruded backing is fused to and is part of the climber over its entire length, this invention is significantly lighter in weight because climber stiffening is selectively applied only where needed and in varying thicknesses as needed. When compared to known art in the lightest adhesive-attached climbers available today, the weight increase of this invention averages less than 3 oz. depending on ski size, and adhesive-attached climbers have many drawbacks and few if any of the advantages of this invention. Some of their drawbacks none of which this invention has are: (1) the ski bottoms must be kept perfectly clean and free of snow, moisture, and contamination if the adhesive is to be effective; (2) ice and debris can tear the climbers loose in turns and traverses, especially at the tail section; (3) attachment and removal from skis is tedious and slow; (4) storage and transport is bulky; and (5) adhesive must be periodically reapplied to the climber.

Figure 4:
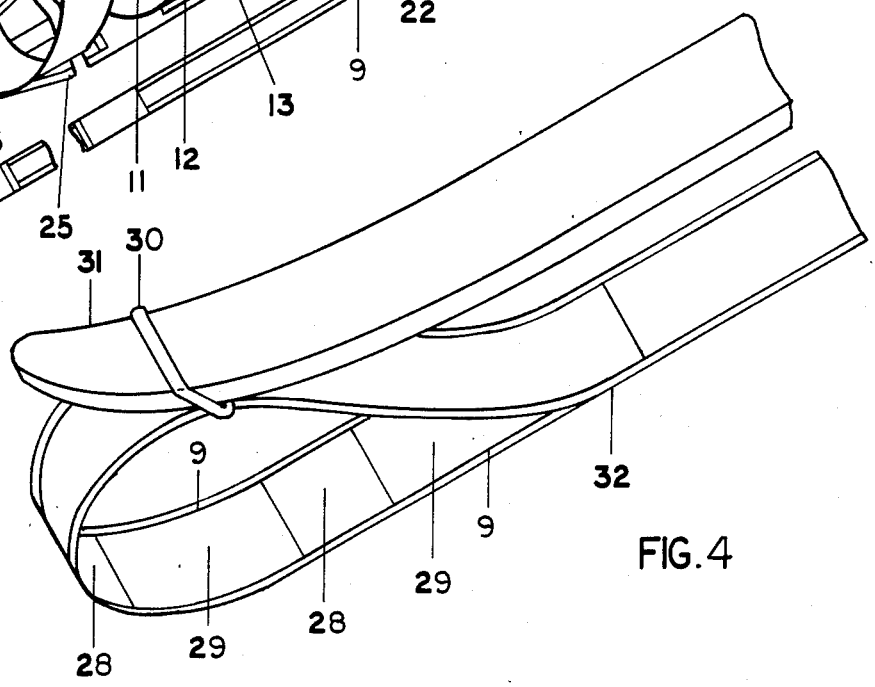
FIG. 4 is a perspective view of the third embodiment of the invention showing the method of attaching the climber to the ski tip.

In the third embodiment of the invention, as seen in FIGS. 1, 4, 5, 6, and 7 pieces of mushroom 28, FIG. 4, and loop 29 material are alternately sewn 9 longitudinally to the forward end of the climber. Urethane adhesives and ultrasonic welding are alternatives to sewing. The climber then is passed through a metal loop 30 located over the ski tip 31, FIGS. 1 and 4, and the climber is then attached to itself 32, FIG. 4, using the mushroom 28 and loop 29 material. This is a one time operation and is repeated only if the climber is used on a ski of a different size.

Figure 5:
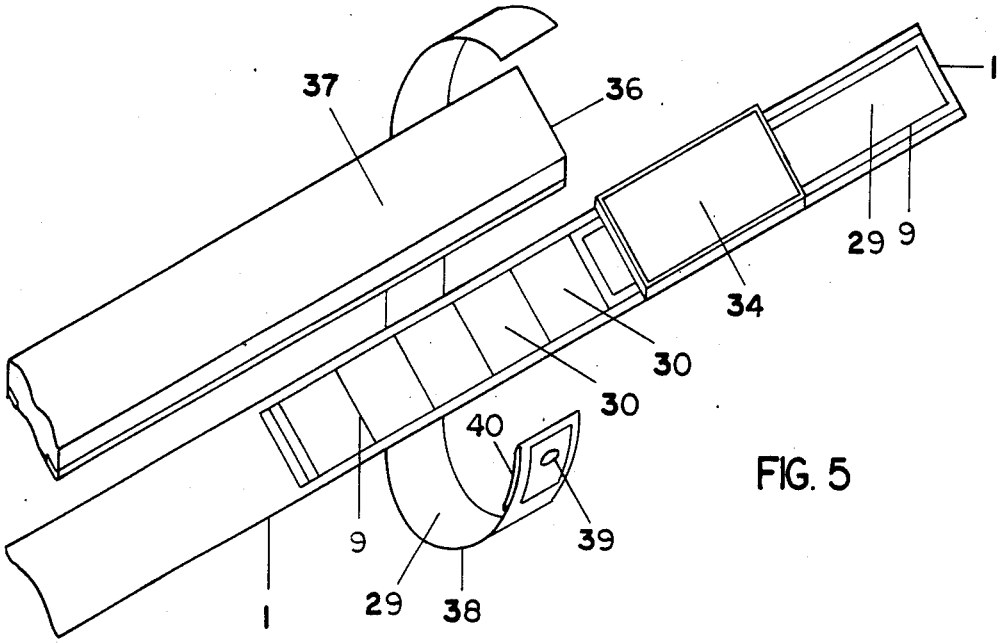
FIG. 5 is an exploded perspective view of the third embodiment of the invention showing the method of attaching the climber to the tail of the ski.
Figure 6:
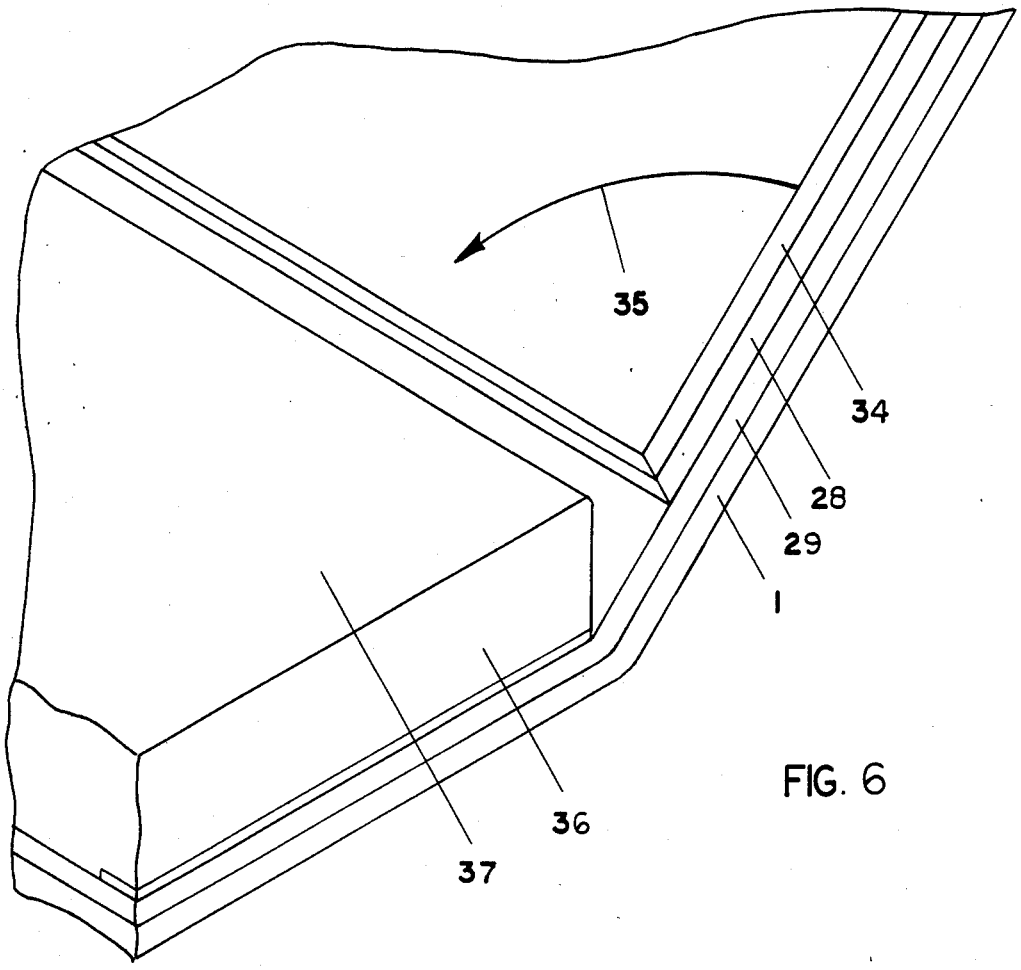
FIG. 6 is a perspective view of the ski tail showing how the tail of the climber rotates to the top of the ski.

The loop portion 29, FIGS. 5 and 6, of a piece of 3M® Corporation Mushroom and Loop material is sewn 9, adhered with polyurethane adhesives, or ultrasonically welded 9 longitudinally to the tail of the climber 33. A piece of the mushroom material 28, FIG. 6, is attached by the same methods to a short thin piece of high density polyethylene or G-10 plastic 34, FIGS. 5 and 6, that is the width of the climber 1. The plastic 34, with mushroom material 28 attached, is then fastened to the loop material 29 on the climber 1 at a location that will most appropriately tension the climber longitudinally when the plastic 34, with climber 1 attached, is rotated 35 up over the tail of the ski 36, FIGS. 6 and 7, to the top of the ski tail 37 and then secured by the tail strap 38. The plastic 34 remains semi permanently attached to and part of the climber until it is relocated to provide additional longitudinal climber tension.

The tail strap 38 is made from 3M® Corporation Mushroom and Loop material, the strap from loop material and the tab 40 from mushroom material. The tail strap 38 is passed through the most appropriate of a selection of sewn 9 or ultrasonically welded 9 lateral climber slots 30, FIG. 5, that will place the tail strap 38 close to the ski tail 36.

Figure 7:
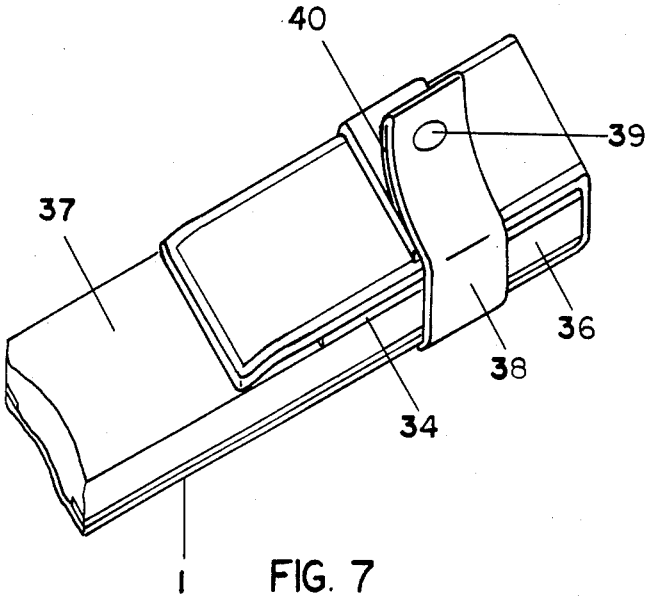
FIG. 7 is a perspective view of the ski tail showing how the tail strap is attached and detached.

A metal or plastic grommet 39, FIGS. 5 and 7, is located at the end of the tail strap 38 through which the tip of a ski pole can be passed and then pushed to quickly disengage the tail strap 38 without requiring the skier to get out of his ski bindings 5.

Figure 8:
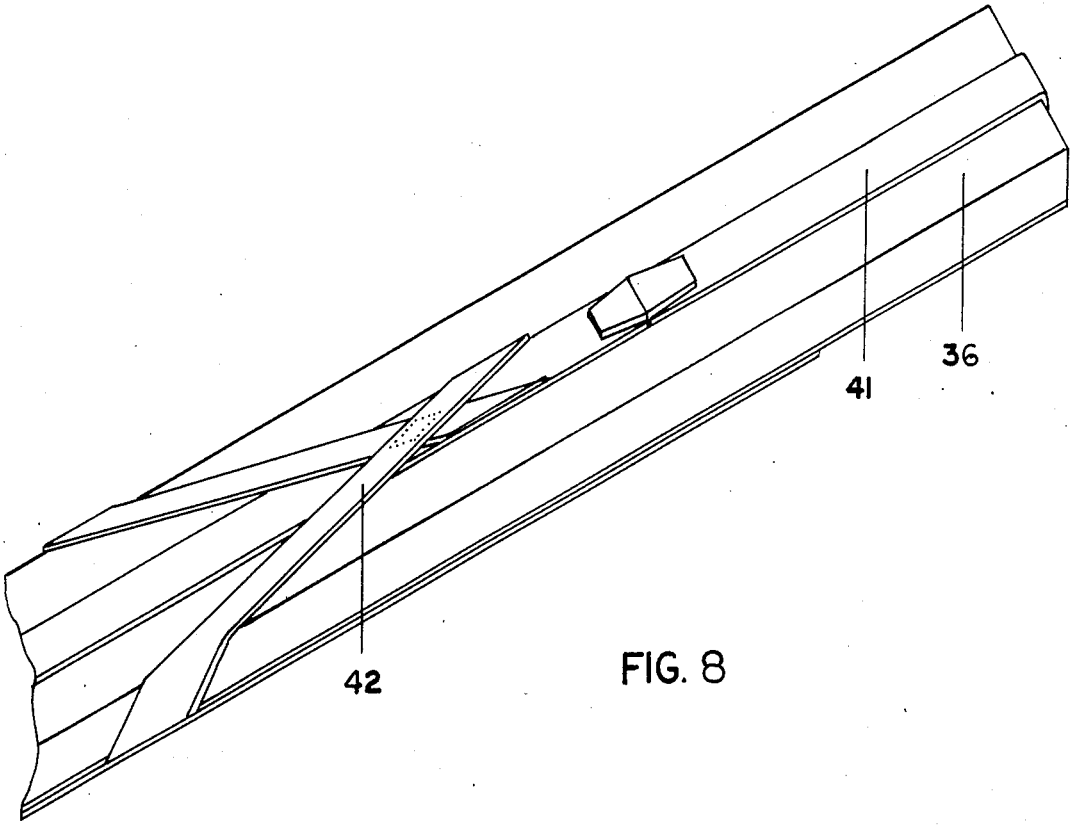
FIG. 8 is a perspective view of a ski tail section of known art showing one way in which climbers are typically attached to the tail of a ski.

The advantages over known art are: (1) the rotated piece of plastic 34 and 35, FIG. 6, with climber 1 attached provides a superior leveraging method for longitudinal climber tensioning that is infinitely adjustable and that remains securely fastened to and becomes part of the climber 1 indefinitely until relocated; (2) the resulting longitudinal climber tensioning in combination with the tail strap 38 assures that the climber 1 tail will not come off of the ski tail 36, a common complaint about climbers; (3) climber tensioning is more stable because there are no longitudinal straps 41, FIG. 8, or harness 42 as in known art that readily stretch when they get wet; (4) climber tension is positive and will not be released because of the substantial shear loads that the mushroom and loop fastener can hold; (5) the climber can be positioned longitudinally so that the short plastic panel 3, FIGS. 1, 2 and 3, can be located directly under the ski binding 5 where it is needed most to resist lateral climber movement 2; (6) one universal length climber fits all skis; (7) the front of the climber pictured in FIG. 4, and the tail of the climber, FIGS. 5, 6, and 7, can be cut to the appropriate length once longitudinal adjustments have been made thus reducing overall weight; (8) if weight is not of concern, cutting can be omitted which then enables the use of the same climber on a continuing basis with a variety of skis regardless of length; (9) the tail strap quick release grommet 39, FIG. 7, provides a significant time saving because the skier does not have to dismount from his skis in order to remove the ski climbers; and (10) because there is no tail harness 42, FIG. 8, the tail of the ski 36 does not have to be threaded through the harness 42 during climber attachment and removal, saving time. In addition, once the tail strap 38, FIG. 7, has been released with the ski pole tip and the body straps 6, 17, FIGS. 1, 2, and 3, have been released, the skier can step back and out of the climbers without dismounting from his skis. This is not possible when the traditional tail harness 42, FIG. 8 of known art, and strap 41 are used because one must dismount, remove the climber from the tip of the ski 31, FIGS. 1 and 4, and then pull the tail of the ski 36, FIG. 3, through the harness 42 to remove the climber.

What is claimed is:

1. An improved ski climber system wherein the climber fabric incorporates a lateral ski climber restraint thus providing a means of retaining the climber within the edges of the ski when subjected to severe side loading during turns and traverses comprising:

a sandwich, the first or top layer of which is constructed of a high density polyethylene plastic panel the width of the climber and the length of the ski binding that is sewn to the climber preventing lateral movement of the climber beyond the ski edges;

a second layer of said plastic several feet long that is sewn to the climber and that further stiffens the area under the binding and that stiffens the body of the climber against lateral movement beyond the ski edges;

four or more body straps made from mushroom and loop fastening system material are passed through slots sewn in the climber;

a single climber tail strap made from said mushroom and loop fastening material which is passed through the most appropriate of a selection of lateral climber slots and fastened over the ski tail securing the tail section of the climber and;

a piece of said polyethylene plastic attached to the tail of the climber using pieces of said mushroom and loop fastening material that are sewn longitudinally to the center of the climber and to the polyethylene plastic over which said tail strap is fastened securing the tail section of the ski and longitudinally tensioning the climber.

2. The system described in claim 1 wherein said polyethylene plastic is G-10 plastic.

3. The system described in claim 1 wherein the sewing is accomplished using ultrasonic welding.

4. The system described in claim 1 wherein the sewing is accomplished using urethane adhesive.

5. The system described in claim 1 wherein said sewn straps are lateral slots through which said straps are passed, thus providing for their removal and replacement when worn and enabling the climber to move freely to the uphill edge of the ski, but not beyond the ski edge.

6. The system described in claim 1 wherein said straps are protected by said polyethylene plastic from being cut or damaged by the sharp metal or plastic edges of the ski.

7. An improved ski climber system that provides for the use of any width of climber fabric, especially very narrow widths, and keeps said fabric in the center of the ski comprising:

a sandwich, the first or top layer of which is constructed of a thin panel of high density polyethylene plastic the width of the ski and the length of the binding, that is located under the binding and that prevents the climber from moving laterally beyond the ski edges;

the first layer also contains short panels of high density polyethylene plastic at strap locations;

a second sandwich layer composed of body straps made from mushroom and loop fastening material that are faster to use and that provide improved shear strength at the closure;

a third sandwich layer constructed of said polyethylene plastic several feet long, the front of which is tapered to reduce forward resistance to the snow and which adds lateral stiffening under the ski binding and to the body of the climber; and a fourth sandwich layer constructed of climber fabric; all sandwich layers being fastened together.

8. The system described in claim 7 wherein the short pieces of polyethylene plastic in the first layer protect said straps from the sharp ski edges and the fourth layer of polyethylene plastic protects said straps from external ice, rocks, and debris.

9. The system described in claim 7 wherein the skier skis on a surface composed of a narrow piece of low forward friction unidirectional climber fabric and wide surfaces of low friction waxable said polyethylene plastic that also covers said body straps eliminating forward motion friction between said body straps and the snow.

10. The system described in claim 7 wherein said polyethylene plastic is G-10 plastic.

11. The system described in claim 7 wherein the sewing is accomplished using ultrasonic welding.

12. The system described in claim 7 wherein the sewing is accomplished using urethane adhesive.

13. In combination a flexible ski climber longitudinally extending along and attached to a ski, including a central binding, said ski climber including:

a front longitudinal tensioning means located at a forward end of the ski climber, said front londitudinal tensioning means including mushroom and loop fastening material; a metal loop located over the tip of the ski, said front longitudinal tensioning means passing through the loop and back upon itself to fix the ski climber at the tip of the ski;

a rear longitudinal tensioning means located at the rearward end of the ski climber, the rearward end of the climber extending from a bottom of the ski over a rear end of the ski to a top surface of the ski and including one of a mushroom and loop fastening material, the rear longitudinal tensioning means further comprising a tail strap with attached polyethylene plastic located adjacent the rearward end of the ski climber and extending transversely thereto, so as to pass over the sides of the ski and cooperate with the fastening material on the top surface of the rearward end of said ski climber, said tail strap further comprising a quick release grommet for engagement with a ski pole tip.

14. The system described in claim 13 wherein said polyethylene plastic is G-10 plastic.

15. The system described in claim 13 wherein said polyethylene plastic is attached by ultrasonic welding.

16. The system described in claim 13 wherein said polyethylene plastic is attached by urethane adhesives.

* * * * *